US008348635B2

(12) United States Patent
Yamashita et al.

(10) Patent No.: US 8,348,635 B2
(45) Date of Patent: Jan. 8, 2013

(54) VARIABLE DISPLACEMENT GEAR PUMP

(75) Inventors: Katsumi Yamashita, Aichi-ken (JP); Shigeru Suzuki, Aichi-ken (JP); Hironao Yokoi, Aichi-ken (JP); Toshiro Fujii, Aichi-ken (JP)

(73) Assignee: Kabushiki Kaisha Toyota Jidoshokki (JP)

( * ) Notice: Subject to any disclaimer, the term of this patent is extended or adjusted under 35 U.S.C. 154(b) by 762 days.

(21) Appl. No.: 12/370,083

(22) Filed: Feb. 12, 2009

(65) Prior Publication Data

US 2009/0208358 A1 Aug. 20, 2009

(30) Foreign Application Priority Data

Feb. 15, 2008 (JP) ..... 2008-033865

(51) Int. Cl.
*F01C 1/14* (2006.01)

(52) U.S. Cl. ..... 417/307; 417/205; 417/213

(58) Field of Classification Search ..... 418/205; 417/307, 62, 213, 242, 300, 319, 410.4, 200, 417/283, 284, 288, 291, 296, 299, 301, 303, 417/304, 308

See application file for complete search history.

(56) References Cited

U.S. PATENT DOCUMENTS 3,753,627 A * 8/1973 Ward ..... 417/213
4,694,648 A * 9/1987 Beck, Jr. ..... 60/452
4,850,806 A * 7/1989 Morgan et al. ..... 417/53
5,110,269 A * 5/1992 Fallon ..... 417/428
6,045,337 A * 4/2000 Tokumasu ..... 417/213
6,537,038 B2 * 3/2003 Bodzak ..... 417/213
2001/0024616 A1 * 9/2001 Kimura et al. ..... 417/213
2003/0223883 A1 * 12/2003 Weber et al. ..... 417/213
2004/0062660 A1 * 4/2004 Kazahaya et al. ..... 417/222.1
2004/0219035 A1 * 11/2004 Hundt et al. ..... 417/368
2008/0118371 A1 * 5/2008 Vasquez et al. ..... 417/77

FOREIGN PATENT DOCUMENTS

JP 5044631 A 2/1993
JP 2002070757 A 3/2002

* cited by examiner

*Primary Examiner* — Anne Hines
*Assistant Examiner* — Jacob R Stern
(74) *Attorney, Agent, or Firm* — Woodcock Washburn LLP

(57) ABSTRACT

The variable displacement gear pump for a loading system in an industrial vehicle has main and sub gear pump portions, suction, discharge and bypass passages, and check and opening valves. The main gear pump portion has main drive and driven gears, and has suction and discharge side spaces. The sub gear pump portion has sub drive and driven gears, and has suction and discharge side spaces. The bypass passage returns hydraulic fluid in the discharge-side space of the sub gear pump portion to the suction passage. The check valve prevents hydraulic fluid in the discharge-side space of the main gear pump portion from flowing to that of the sub gear pump portion. The opening valve is used for opening and closing the bypass passage, and closes the bypass passage due to a pressure in a discharge conduit of the loading system increased by the load applied to the loading system.

9 Claims, 8 Drawing Sheets

VARIABLE DISPLACEMENT GEAR PUMP

CROSS REFERENCE TO RELATED APPLICATION

This application claims priority to Japanese Patent Application No. 2008-033865 filed Feb. 15, 2008.

BACKGROUND OF THE INVENTION

The present invention relates to a variable displacement gear pump.

A gear pump has a drive gear and a driven gear engaged with each other to raise a pressure and transferring fluid out of the pump. If the fluid to be pumped by the gear pump is a hydraulic fluid, the gear pump can actuate various hydraulic devices provided in a hydraulic circuit. The gear pump is simple in structure, easy to operate and maintain and low in cost in comparison with other types of pump. Additionally, the gear pump is hardly influenced by foreign matters contained in fluid, and suitable for reduction in size and weight. Thus, the gear pump is used advantageously, for example, for a hydraulic fluid pump driven by an internal combustion engine or an electric motor of an industrial vehicle such as a forklift truck.

The displacement of a gear pump is determined by its rotational speed and, therefore, it is difficult to change the displacement of the gear pump without consideration of the rotational speed of the gear pump. Excessive displacement will force the gear pump to do extra work. Therefore, a variable displacement gear pump has been proposed which changes the pump displacement by using a plurality of gear mechanisms. In this variable displacement gear pump, changing of the displacement is accomplished by changing between two mode operations. In one mode operation, a specific gear mechanism is used to pump and discharge fluid, and in the other mode operation, the pumped fluid is returned from the gear mechanism to an inlet port of the gear pump.

The Japanese Patent Application Publication No. 2002-70757 discloses a variable displacement gear pump having in its casing a drive gear and two driven gears engaged with the drive gear thereby to form a main body of the gear pump. The main body of the gear pump has two pump lines including a first pump and a second pump, which functions as a double gear pump. Outlet and inlet ports of the second gear pump are connected with each other through an unload passage having therein an electromagnetic opening valve. When the electromagnetic opening valve is closed, the first and second pumps are operated in parallel, thereby increasing the displacement of the gear pump. During this operation, the gear pump is operating at a large displacement. When the electromagnetic opening valve is opened, the second pump is unloaded thereby to decrease the displacement of the gear pump. During this operation, the gear pump is operating at a small displacement.

In this type of variable displacement gear pump, the first and second pumps are arranged parallel to each other. Because of the rotational direction of the drive shaft, inlet and outlet ports of the first pump are located opposite to the inlet and outlet ports of the second pump, respectively. That is, the inlet port of the first pump and the outlet port of the second pump are located on one side of the gear pump, while the outlet port of the first pump and the inlet port of the second pump are located on the other side of the gear pump. The variable displacement gear pump has suction and discharge passages formed by merging passages on the suction and discharge sides of the first and second pumps, respectively.

In the variable displacement gear pump disclosed in Japanese Patent Application Publication 2002-70757, if the unload passage ensures sufficient flow rate for unloading, the unload passage must be formed with a large cross-section. Thus, an electromagnetic valve to be provided in the unload passage will become inevitably larger in size as the cross-section of the unload passage is increased.

The present invention which has been made in light of the above problems is directed to providing a variable displacement gear pump. The variable displacement gear pump is operated without using an electromagnetic valve serving as an opening valve in a bypass passage through which hydraulic fluid discharged to a discharge-side space of a sub gear pump portion is returned to a suction passage.

SUMMARY OF THE INVENTION

In accordance with the present invention, the variable displacement gear pump is used for a loading system in an industrial vehicle. The industrial vehicle has an actuator of the loading system, a control valve for hydraulically controlling the actuator, and a discharge conduit of the loading system connecting the control valve to the actuator. The variable displacement gear pump has a main gear pump portion, a sub gear pump portion, a suction passage, a discharge passage, a bypass passage, a check valve, and an opening valve. The main gear pump portion has a main drive gear and a main driven gear engaged with each other, the main gear pump portion having a suction-side space and a discharge-side space formed therein. The sub gear pump portion has a sub drive gear and a sub driven gear engaged with each other, the sub gear pump portion having a suction-side space and the discharge-side space formed therein. The suction passage communicates with the suction-side spaces of the main and sub gear pump portions. The discharge passage communicates with the discharge-side spaces of the main and sub gear pump portions. The discharge passage is in communication with the control valve. The bypass passage returns hydraulic fluid in the discharge-side space of the sub gear mechanism to the suction passage. The check valve prevents hydraulic fluid in the discharge-side space of the main gear mechanism from flowing to the discharge-side space of the sub gear mechanism. An opening valve is used for opening and closing the bypass passage. The opening valve has a first pressure receiving surface which receives a pressure in the bypass passage, and a second pressure receiving surface which receives a pressure in the discharge conduit. The opening valve closes the bypass passage due to a pressure in the discharge conduit increased by the load applied to the loading system.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

The following will describe a variable displacement gear pump according to the preferred embodiment of the present invention with reference to FIGS. 1 through 8.

Figure 1:
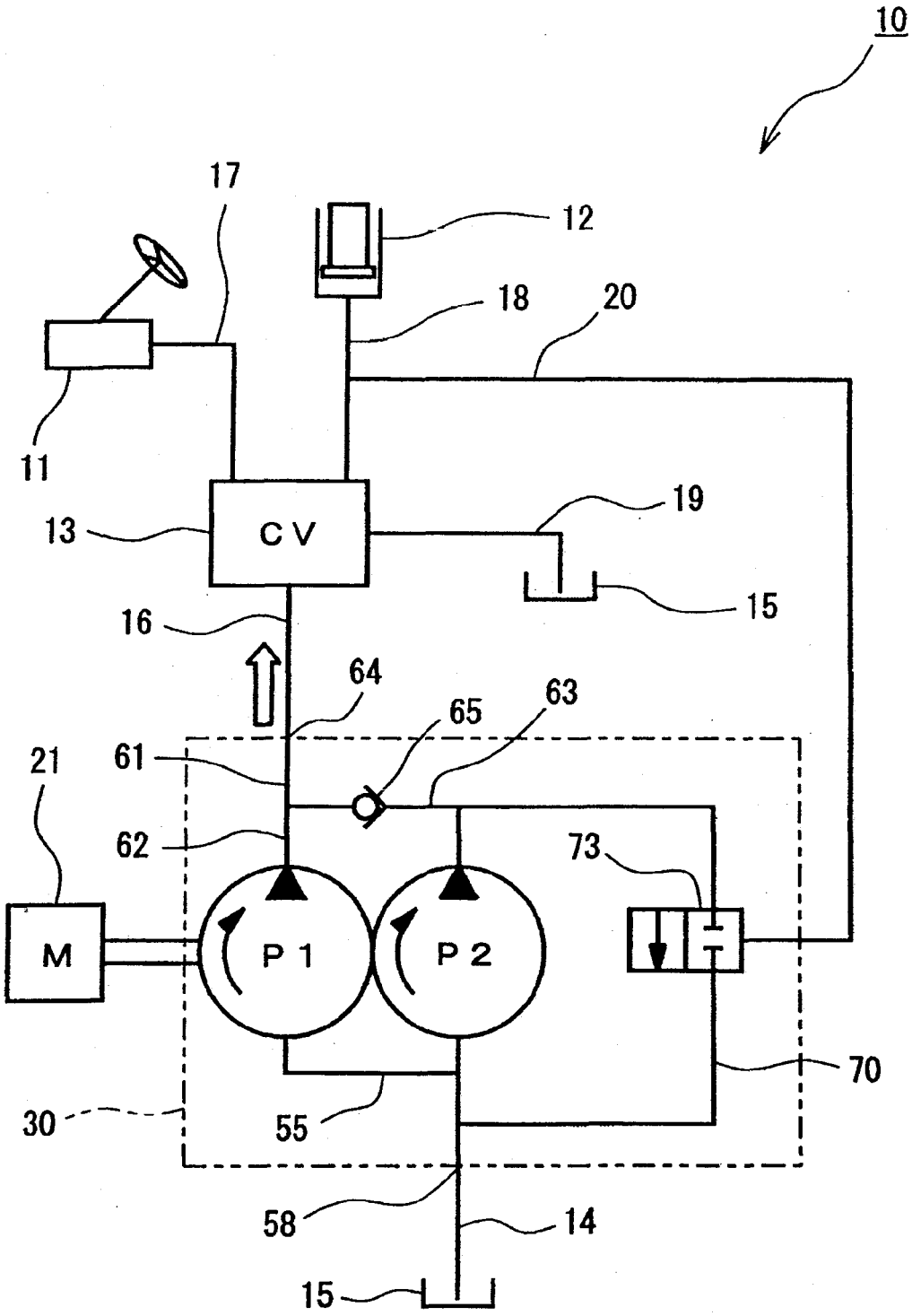
FIG. 1 is a hydraulic circuit diagram showing a hydraulic system for a forklift truck according to a preferred embodiment of the present invention.

Referring to FIG. 1, a hydraulic system 10 for hydraulically controlling actuators for a loading system or a power steering system of a forklift truck is shown. The loading system used for handling a load has forks engageable with a load, and a mast for raising and lowering the forks. The power steering system is used for reducing the steering effort by using a hydraulic power to assist in turning the wheels. The hydraulic system 10 of the preferred embodiment has a variable displacement gear pump (hereinafter referred to as "gear pump") 30, an actuator 11 of the power steering system, a lift cylinder 12 serving as an actuator of the loading system, and a control valve 13 for hydraulically controlling the actuators 11, 12.

The gear pump 30 is driven by an engine 21 as an external drive source, and has a main gear pump portion P1 and a sub gear pump portion P2. The gear pump 30 has an inlet port 58 connected to an oil reservoir 15 through a suction conduit 14, and an outlet port 64 connected to an inlet port of the control valve 13 through a supply conduit 16. The gear pump 30 will be described in detail later.

The control valve 13 is used for hydraulically controlling a plurality of actuators in the forklift truck. The control valve 13 has a plurality of outlet ports connected to the actuators through respective discharge conduits for supplying hydraulic fluid to the actuators.

In FIG. 1, a discharge conduit 17 for the power steering system connected to the actuator 11 of the power steering system, a discharge conduit 18 connected to the lift cylinder 12 of the loading system, and a return conduit 19 for returning hydraulic fluid to the oil reservoir 15 are shown. The discharge conduit 18 has a communication conduit 20 branched therefrom, and connected to the gear pump 30. Hydraulic oil flows constantly through the discharge conduit 17 for the power steering system while the gear pump 30 is in operation.

In this hydraulic system 10, hydraulic fluid is constantly supplied to the actuator 11 for the power steering system while the gear pump 30 is in operation. When the lift cylinder 12 requires hydraulic fluid, or when the loading system is operated, hydraulic fluid is supplied to the lift cylinder 12 by operating the control valve 13.

Figure 2:
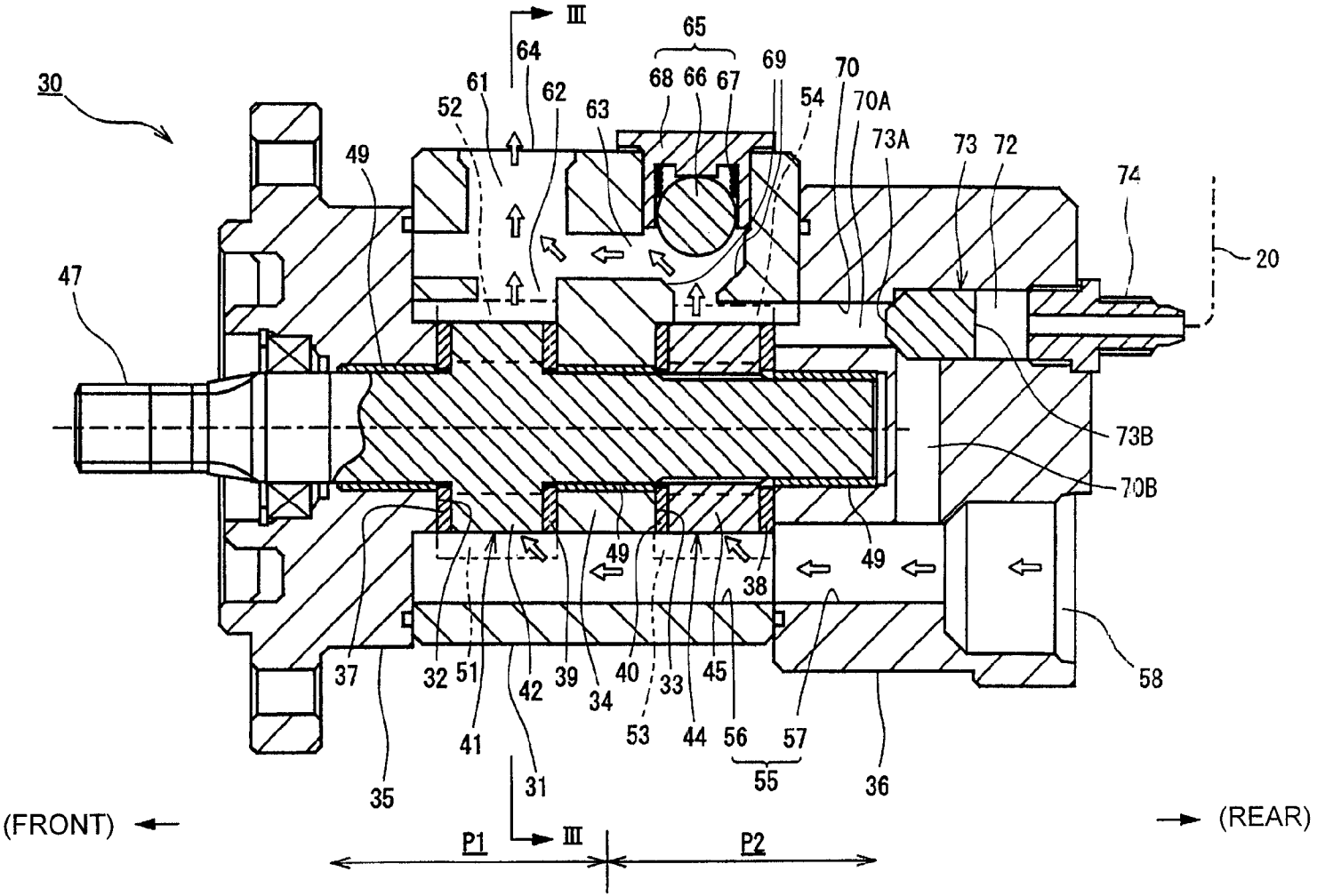
FIG. 2 is a longitudinal cross-sectional view of a variable displacement gear pump according to the preferred embodiment of the present invention.

The following will describe the gear pump 30 in detail. Referring to FIG. 2, the gear pump 30 in FIG. 2 has a body 31 for accommodating therein a main drive gear 42, a sub drive gear 45, a main driven gear 43 and a sub driven gear 46. Two spaces are formed in the body 31, namely a main gear chamber 32, and a sub gear chamber 33. A partition 34 is formed between the main gear chamber 32 and the sub gear chamber 33.

The body 31 is connected at one end surface thereof to a front housing 35, and at the other end surface thereof to a rear housing 36. According to the preferred embodiment, the body 31, the front housing 35 and the rear housing 36 cooperate to form a housing assembly of the gear pump 30. The body 31, the front housing 35 and the rear housing 36 are connected to each other by means of bolts 50 shown in FIG. 3. Referring to FIG. 2, the side of the gear pump 30 adjacent to the front housing 35 corresponds to the front side of the gear pump 30, and the opposite side thereof adjacent to the rear housing 36 corresponds to the rear side, as indicated by arrows. The main gear chamber 32 is closed by the front housing 35, and the sub gear chamber 33 is closed by the rear housing 36. A side plate 37 is disposed between the main gear chamber 32 and the end surface of the front housing 35, and a side plate 38 is disposed between the sub gear chamber 33 and the end surface of the rear housing 36. A side plate 39 is disposed between the main gear chamber 32 and the partition 34, and a side plate 40 is disposed between the sub gear chamber 33 and the partition 34.

The main gear chamber 32 accommodates therein a main gear mechanism 41 having the main drive gear 42 and the main driven gear 43 contacted and engaged with each other. The sub gear chamber 33 accommodates therein a sub gear mechanism 44 having the sub drive gear 45 and the sub driven gear 46 contacted and engaged with each other. The main drive gear 42 located on the front side of the gear pump 30 and accommodated in the main gear chamber 32 is formed integrally and coaxially with a drive shaft 47 of the gear pump 30. The sub drive gear 45 located on the rear side of the gear pump 30 and accommodated in the sub gear chamber 33 is connected coaxially to the drive shaft 47 by means of a spline-fitting or a serration-fitting. Therefore, the main drive gear 42 and the sub drive gear 45 are arranged coaxially.

The drive shaft 47 extends through the front housing 35, the side plate 37, the side plate 39, the partition 34, the side plate 40 and the side plate 38, and into the rear housing 36. The drive shaft 47 is rotatably supported by the front housing 35, the body 31, and the rear housing 36 through bearings 49. One end of the drive shaft 47 extends out of the front housing 35, and connected to an engine 21 as an external drive source.

The main driven gear 43 on the front side of the gear pump 30 is formed integrally and coaxially with the driven shaft 48. The sub driven gear 46 on the rear side of the gear pump 30 is connected coaxially to the driven shaft 48 by means of a spline-fitting or a serration-fitting. The driven shaft 48 extends into the front housing 35 and the rear housing 36 as in the case of the drive shaft 47. The driven shaft 48 is supported by the front housing 35, body 31, and the rear housing 36 through the bearings 49. Thus, the main driven gear 43 is arranged coaxially with the sub driven gear 46. Unlike the drive shaft 47, one end of the driven shaft 48 does not extend out of the front housing 35.

Figure 3:
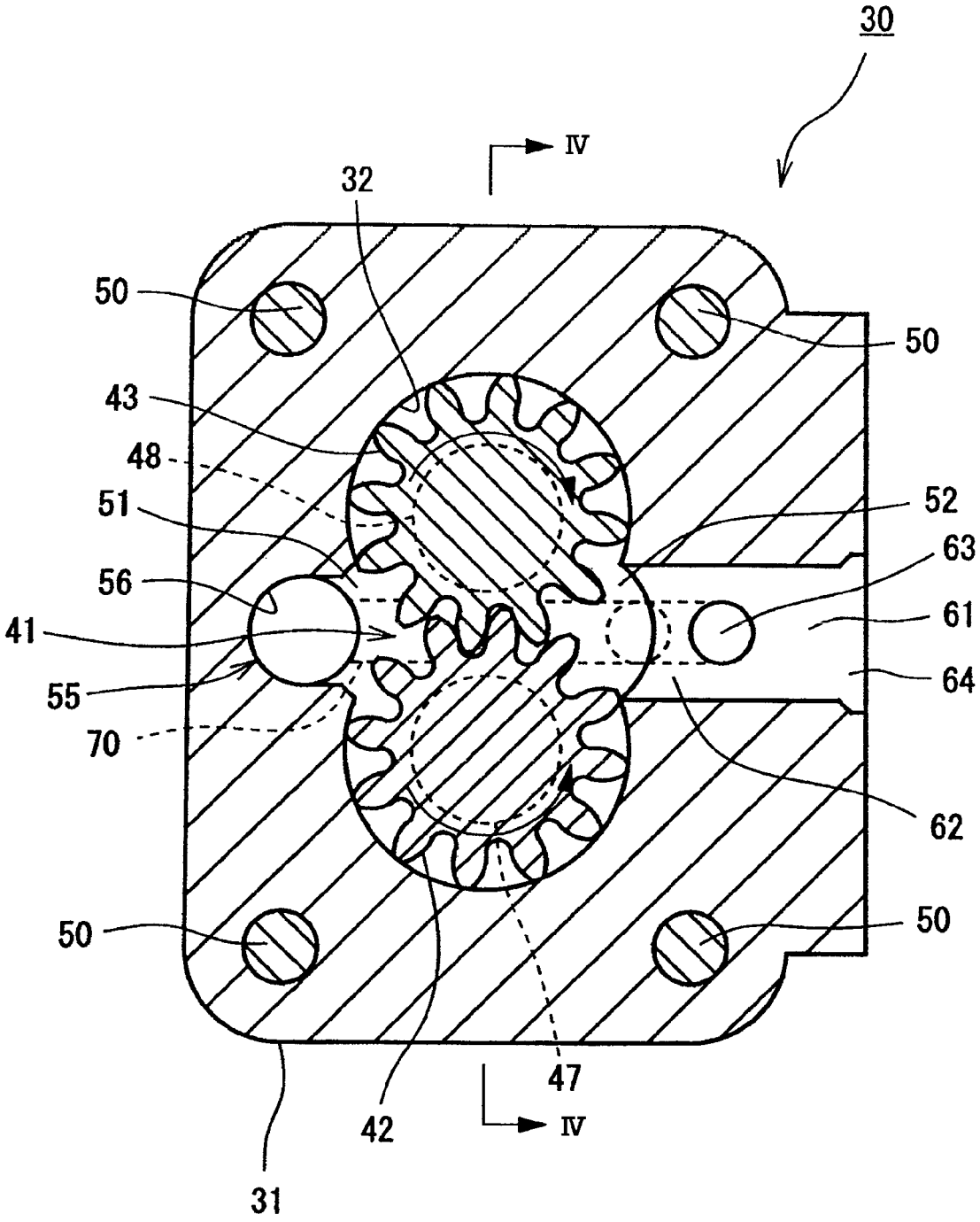
FIG. 3 is a cross-sectional view taken along the line III-III in FIG. 2.
Figure 4:
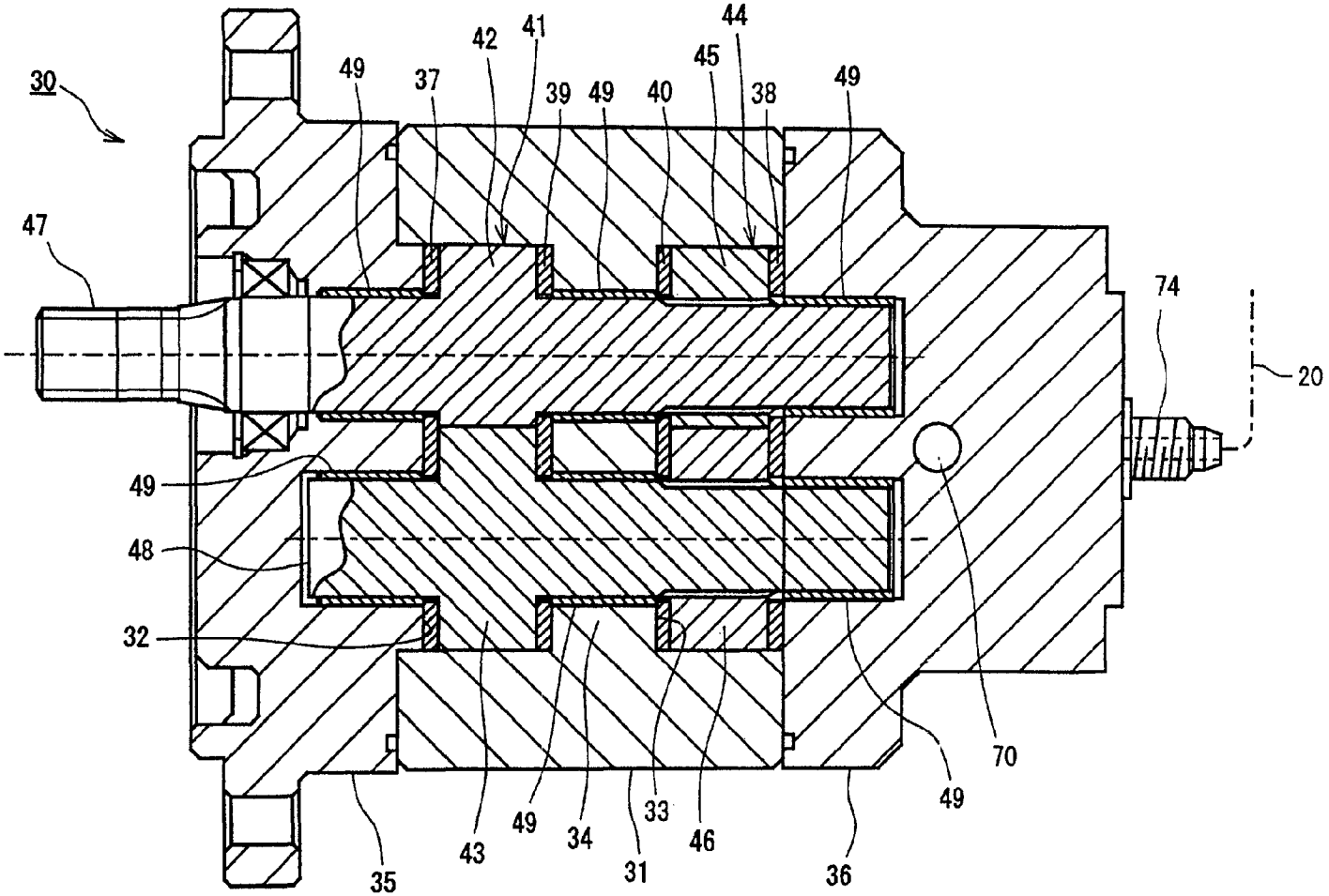
FIG. 4 is a cross-sectional view taken along the line IV-IV in FIG. 3.

As shown in FIG. 3, the main gear chamber 32 has two spaces defined by the inner peripheral surface of the main gear chamber 32, the main drive gear 42, and the main driven gear 43. Namely, one is the suction-side space 51 defined on the side where hydraulic fluid is drawn in, and the other is a discharge-side space 52 defined on the side where hydraulic fluid is discharged out. As shown in FIG. 2, the sub gear chamber 33 has also the suction-side space 53 and the discharge-side space 54.

As shown in FIG. 2, the main gear pump portion P1 has the main drive and driven gears 42, 43 in the main gear mechanism 41, and the suction and discharge side spaces 51, 52 in the main gear chamber 32 on the front side of the gear pump 30. Also, the sub gear pump portion P2 has the sub drive and driven gears 45, 46 in the sub gear mechanism 44, and the suction and discharge side spaces 53, 54 in the sub gear chamber 33 on the rear side of the gear pump 30. Each of the main gear pump portion P1 and the sub gear pump portion P2 provides 50% of the total displacement of the gear pump 30.

A body-side suction passage 56 is formed in the body 31 in parallel to the axes of the drive shaft 47 and the driven shaft 48 for drawing hydraulic fluid into the main gear chamber 32 and the sub gear chamber 33. A rear-side suction passage 57 is formed in the rear housing 36 on the rear side of the gear pump 30 for communication with the body-side suction passage 56. The rear-side suction passage 57 has an inlet port 58 opened at the rear end surface of the rear housing 36 parallel to the axis of the drive shaft 47 for communication with the outside of the gear pump 30. The body-side suction passage 56 and the rear-side suction passage 57 have a respective circular cross-section, and are linearly connected to each other. The body-side suction passage 56 and the rear-side suction passage 57 form a suction passage 55. The suction passage 55 communicates with the suction-side space 51 of the main gear pump portion P1 and the suction-side space 53 of the sub gear pump portion P2. Hydraulic fluid flowing from the outside of the gear pump 30 flows into the main and sub gear chambers 32, 33 through the suction passage 55.

Front-side and rear-side discharge passages 62, 63 are formed in the body 31 for discharging hydraulic fluid pressurized in the main gear chamber 32 and the sub gear chamber 33 out of the gear pump 30. The front-side discharge passage 62 extends from the discharge-side space 52 in the main gear chamber 32, while the rear-side discharge passage 63 extends from the discharge-side space 54 in the sub gear chamber 33. The front-side and rear-side discharge passages 62, 63 are joined together to form a discharge passage 61 in the body 31. The discharge passage 61 communicates with the discharge-side space 52 of the main gear pump portion P1 and the discharge-side space 54 of the sub gear pump portion P2. The discharge passage 61 has an outlet port 64 through which hydraulic fluid is pumped out of the gear pump 30, and the discharge passage 61 is in communication with the control valve 13. Hydraulic fluid in the discharge passage 61 thus discharged out of the gear pump 30 through the outlet port 64 is supplied to the control valve 13 through the supply conduit 16. The rear-side discharge passage 63 has a check valve 65 for preventing hydraulic fluid from backflowing to the discharge-side space 54 in the sub gear chamber 33.

The check valve 65 has a valve body 66, a coil spring 67, and a support member 68. The valve body 66 having a spherical shape opens and closes the rear-side discharge passage 63, the coil spring 67 urges the valve body 66, and the support member 68 supports the coil spring 67. The coil spring 67 urges the valve body 66 in such a direction that the rear-side discharge passage 63 is closed by the valve body 66. When the pressure in the rear-side discharge passage 63 becomes greater than a predetermined pressure, the valve body 66 is moved in the direction where the rear-side discharge passage 63 is opened against the urging force of the coil spring 67. When the pressure of the rear-side discharge passage 63 becomes smaller than a predetermined pressure, the valve body 66 is moved to close the rear-side discharge passage 63 by the urging force of the coil spring 67 and a pressure differential between the front-side and rear-side discharge passages 62, 63. Referring to FIG. 2, a valve seat 69 is formed adjacent to the discharge-side space 54 in a body 31. Since the valve body 66 is urged against the valve seat 69 also by the pressure differential, the urging force of the coil spring 67 may be set at a relatively small value. The shape of the valve body 66 is not limited to a spherical shape, but may have a conical shape.

A bypass passage 70 is formed in the rear housing 36 for communication with the rear-side discharge passage 63 and the rear-side suction passage 57. The bypass passage 70 connects the suction passage 55 to the discharge-side space 54 in the sub gear chamber 33. The bypass passage 70 has an opening valve for opening and closing the bypass passage 70. The bypass passage 70 has an upstream passage 70A in a region upstream of the opening valve and a downstream passage 70B in a region downstream of the opening valve.

The rear housing 36 has a cylinder 72 with a bottom formed therein, and a piston 73 having a cylindrical shape and serving as the aforementioned opening valve is received slidably in the cylinder 72. Space in the cylinder 72 is in communication with the discharge conduit 18 through a nipple 74, and the communication conduit 20. Thus, a pressure in the discharge conduit 18 is applied to the space in cylinder 72. The cross-sectional area of the cylinder 72 is set greater than that of the upstream passage 70A of the bypass passage 70.

The piston 73 has an outer diameter corresponding to an inner diameter of the cylinder 72. The piston 73 is slidable in contact with the inner surface of the cylinder 72 thereby to open and close the bypass passage 70. The piston 73 has at one end thereof a first pressure receiving surface 73A receiving a pressure in the bypass passage 70.

The piston 73 has at the other end thereof a second pressure receiving surface 73B receiving a pressure in the cylinder 72, or a pressure in the discharge conduit 18. According to the preferred embodiment, the cross-sectional area of the cylinder 72 is set greater than that of the upstream passage 70A of the bypass passage 70. The area of the second pressure receiving surface 73B is greater than the pressure receiving area of the first pressure receiving surface 73A receiving the pressure in the upstream passage 70A when the bypass passage 70 is closed by the piston 73. This pressure receiving area is provided on the first pressure receiving surface 73A as an area receiving a discharge pressure from the sub gear pump portion P2 when the bypass passage 70 is closed by the piston 73, and is smaller than the area of the second pressure receiving surface 73B.

The difference of pressures acting on the first and second pressure receiving surfaces 73A, 73B of the piston 73 causes the piston 73 to slide. That is, the pressure differential between the pressure in the cylinder 72 on the near side to the bypass passage 70 with respect to the piston 73 and the pressure in the cylinder 72 on the opposite side of the piston 73 causes the piston 73 to slide. When the piston 73 opens the bypass passage 70, the area of the second pressure receiving surface 73B is greater than the pressure receiving area of the first pressure receiving surface 73A which receives the pressure in the upstream passage 70A. Thus, if the upstream passage 70A and the cylinder 72 have the same pressure, a load acting on the second pressure receiving surface 73B is greater than the load acting on the pressure receiving area of the first pressure receiving surface 73A. Therefore, the bypass passage 70 is kept closed by the piston 73.

Figure 5:
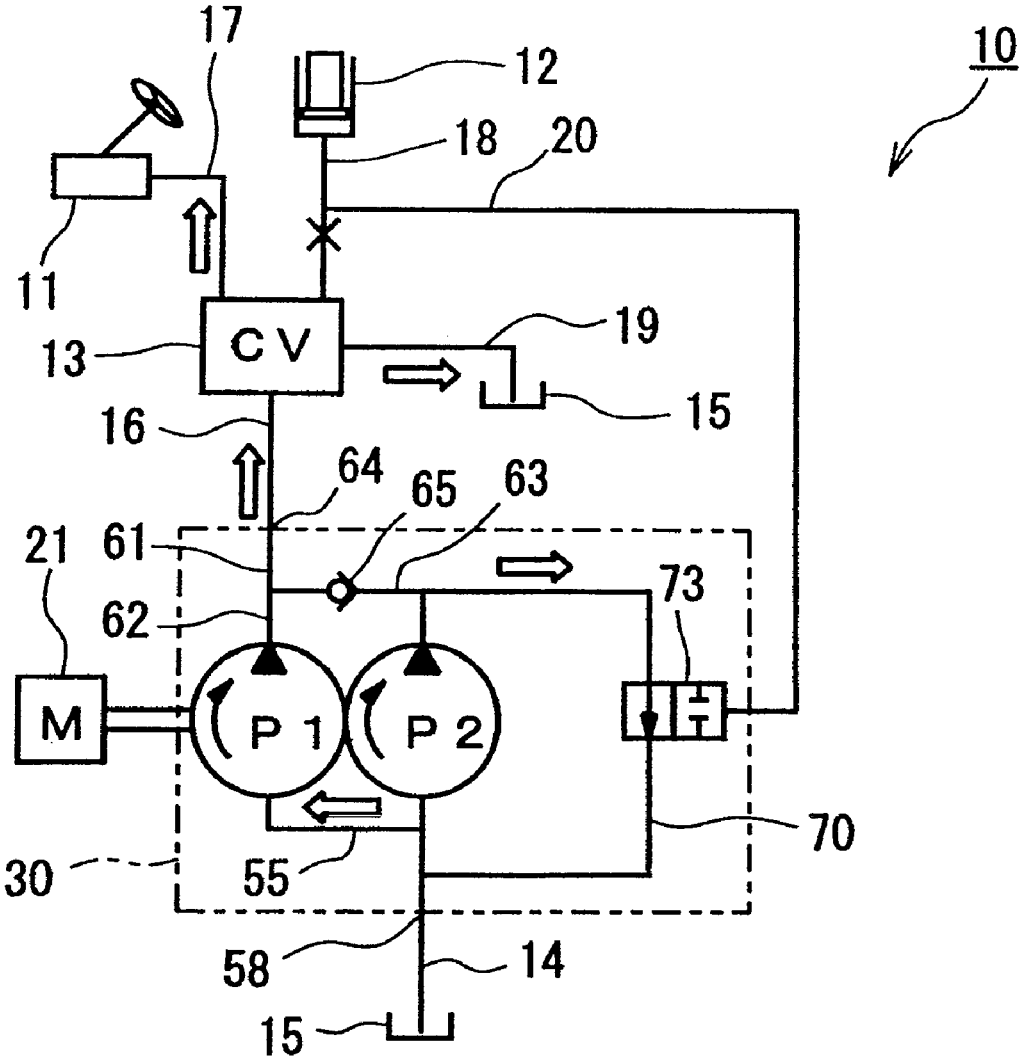
FIG. 5 is a hydraulic circuit diagram showing the state of the hydraulic system during small displacement operation of the variable displacement gear pump.
Figure 6:
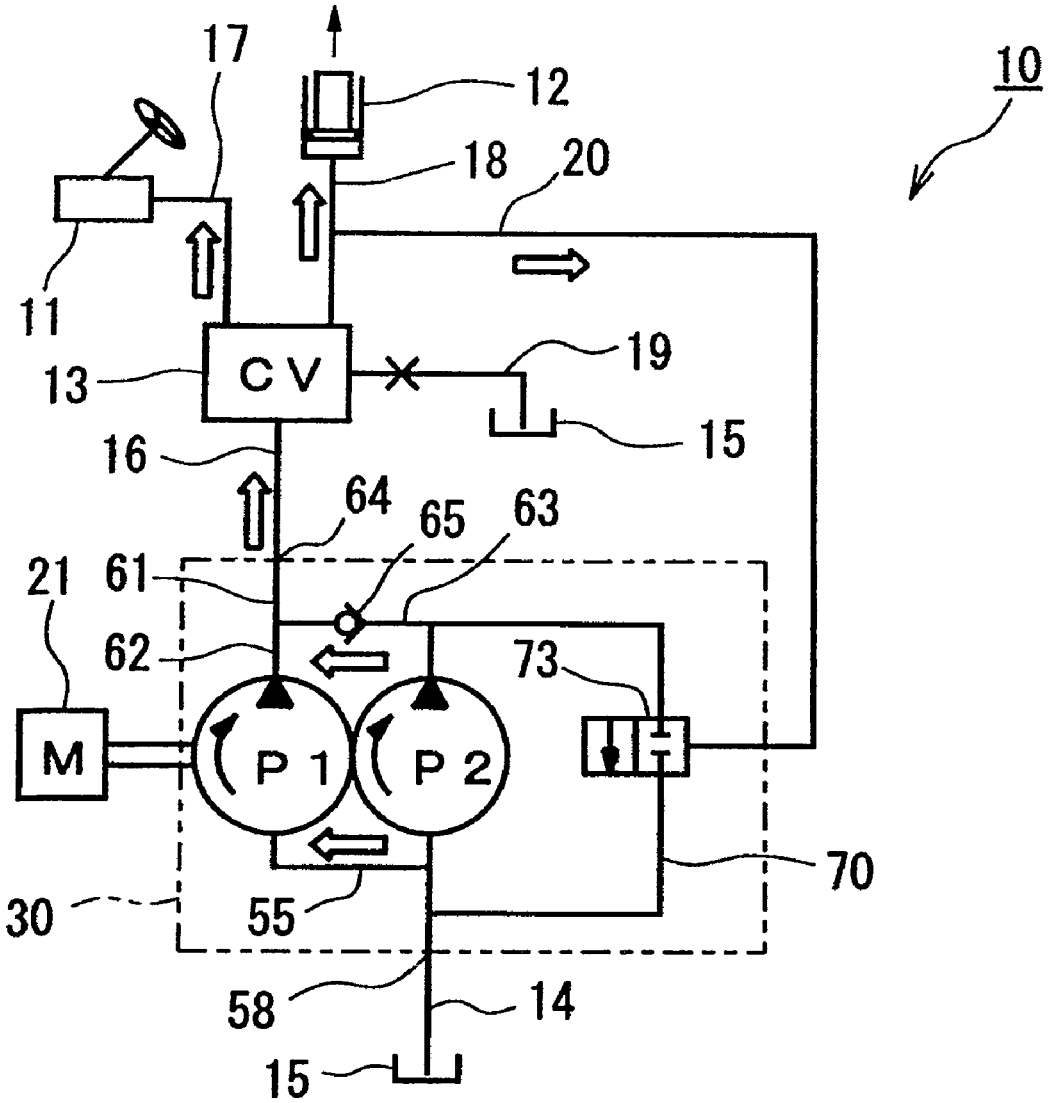
FIG. 6 is a hydraulic circuit diagram showing the state of the hydraulic system during large displacement operation of the variable displacement gear pump.
Figure 7:
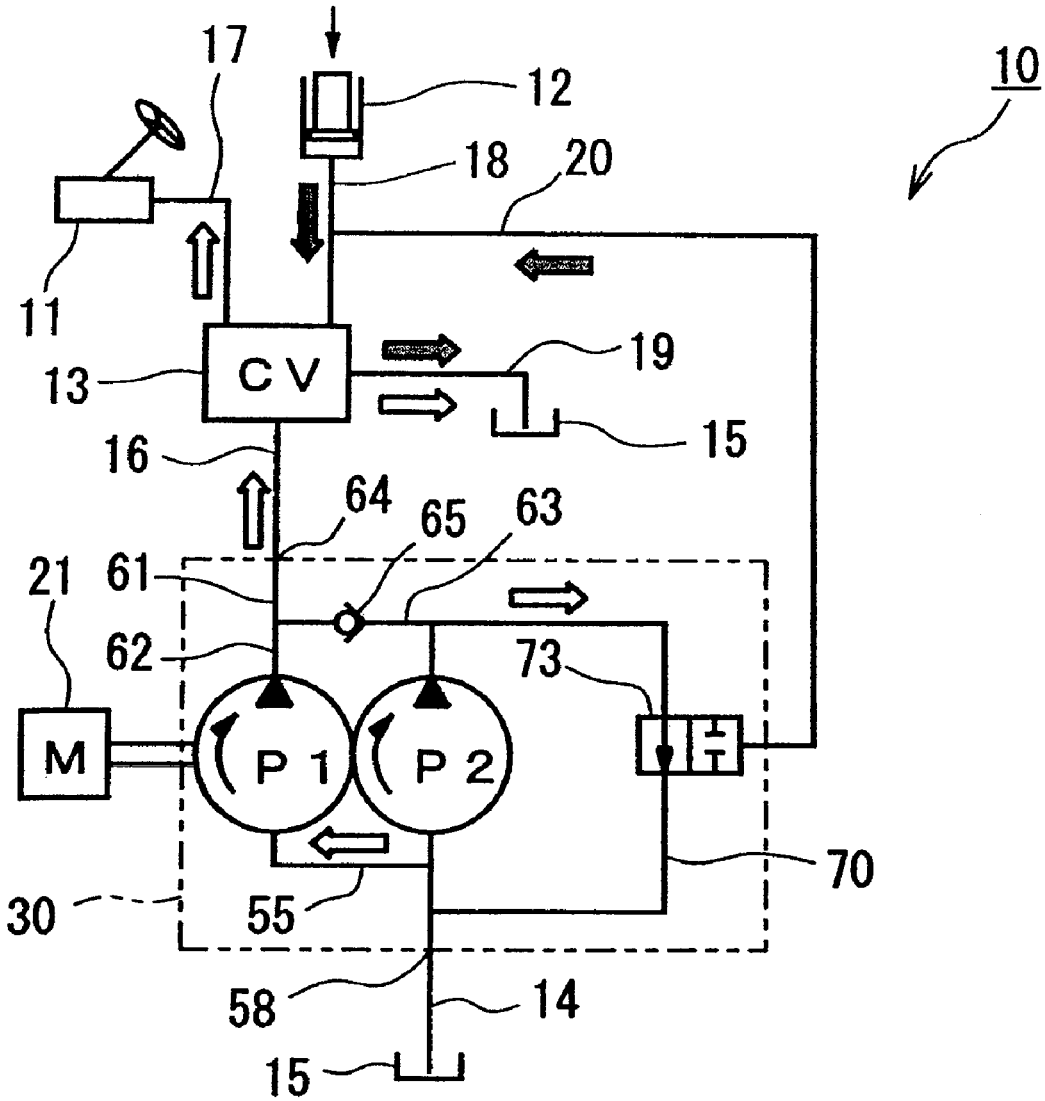
FIG. 7 is a hydraulic circuit diagram showing the state of the hydraulic system when the variable displacement gear pump changes its operation from large displacement to small displacement.

The following will describe the operation of the hydraulic system 10 and the operation of the gear pump 30 according to the preferred embodiment of the present invention with reference to FIGS. 5 through 7. Firstly, the state where the gear pump 30 is operating at a small displacement as shown in FIG. 5 will be described. When the gear pump 30 is operating at a small displacement, the gear pump 30 supplies to the control valve 13 only the hydraulic fluid discharged from the main gear pump portion P1, and then to the actuator 11 of the power steering system through the discharge conduit 17 of the power steering system. The gear pump 30 supplies no hydraulic fluid to the lift cylinder 12, and the surplus hydraulic fluid is returned to the oil reservoir 15. Hydraulic fluid discharged from the sub gear pump portion P2 is returned to the suction passage 55 through the bypass passage 70.

The following will describe operation of the main drive gear 42 and the main driven gear 43 of the main gear pump portion P1. When drive force is applied to the drive shaft 47 from the outside of the gear pump 30, the main drive gear 42 rotates in one direction indicated by an arrow in FIG. 3. Accordingly, the main driven gear 43 engaged with the main drive gear 42 is rotated with the driven shaft 48 in the direction opposite to the rotational direction of the main drive gear 42. The rotation of the main drive gear 42 and the main driven gear 43 causes hydraulic fluid to be drawn into the suction-side space 51 from the suction passage 55.

Hydraulic fluid thus drawn into the suction-side space 51 is then enclosed in spaces defined by the surface of teeth of the main drive gear 42 and the inner peripheral surface of the main gear chamber 32, or by the surface of teeth of the main driven gear 43 and the inner peripheral surface of the main gear chamber 32. Hydraulic fluid thus enclosed in the spaces is carried along the inner peripheral surface of the main gear chamber 32 in the rotational directions of the main drive gear 42 and the main driven gear 43, respectively. Then, hydraulic fluid is discharged into the discharge-side space 52, and flowed through the front-side discharge passage 62 and the discharge passage 61. Subsequently, hydraulic fluid is discharged out of the gear pump 30 through the outlet port 64, and transferred to the control valve 13.

In the main gear pump portion P1, when the external drive force is transmitted to the drive shaft 47, the main drive gear 42 and the main driven gear 43 in the main gear chamber 32 are driven to rotate, and hydraulic fluid is discharged into the discharge-side space 52, and then supplied to the front-side discharge passage 62. In the sub gear pump portion P2, when the external drive force is transmitted to the drive shaft 47, the sub drive gear 45 and the sub driven gear 46 in the sub gear chamber 33 are driven to rotate, thereby discharging hydraulic fluid into the discharge-side space 54.

During the small displacement operation of the gear pump 30, the pressure in the discharge conduit 18 receives no load from the lift cylinder 12. Therefore, the pressure in the discharge conduit 18 is lower in comparison with the case when hydraulic fluid is being supplied to the lift cylinder 12. When the pressure in the discharge conduit 18 is thus relatively low, the pressure in the cylinder 72 of the gear pump 30 that is in communication with the discharge conduit 18 through the communication conduit 20 is also lower. A load generated by the pressure in the discharge conduit 18 acts on the second pressure receiving surface 73B of the piston 73 of the gear pump 30 in the direction which closes the bypass passage 70.

Figure 8:
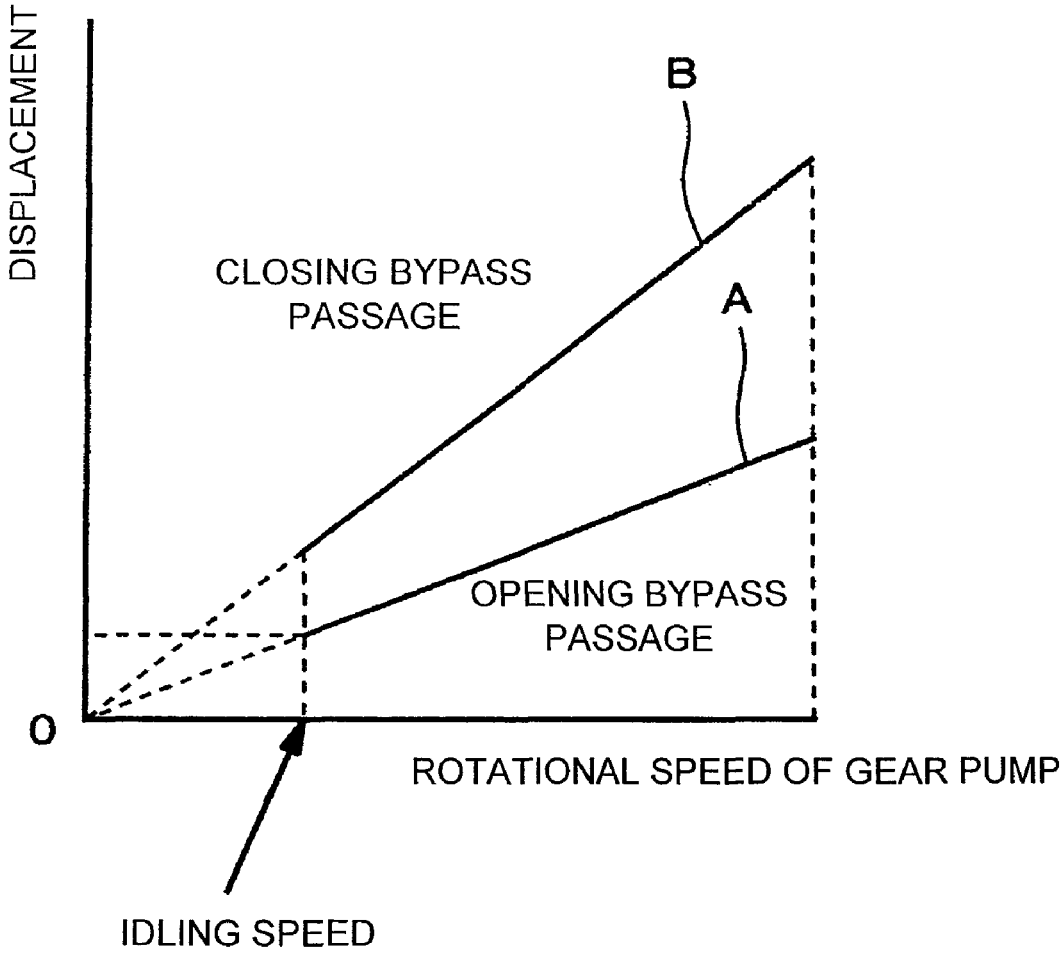
FIG. 8 is a graph showing flow rate characteristics of the variable displacement gear pump according to the preferred embodiment of the present invention.

Hydraulic fluid discharged by the sub gear pump portion P2 of the gear pump 30 into the discharge-side space 54 is introduced into the bypass passage 70. A load generated by the pressure in the bypass passage 70 acts on the first pressure receiving surface 73A of the piston 73. When no loading operation is performed, the load acting on the first pressure receiving surface 73A is greater than the load acting on the second pressure receiving surface 73B, so that the piston 73 opens the bypass passage 70. When the bypass passage 70 is opened, the pressure in the discharge-side space 54 on the upstream side of the bypass passage 70 is decreased. The urging force of the coil spring 67 and the pressure transmitted from the main gear pump portion P1 acting on the valve body 66 keeps the rear-side discharge passage 63 closed. The displacement of the gear pump 30 during its small displacement operation corresponds to the displacement at the idling speed of Graph A in FIG. 8. The displacement of the gear pump 30 at the idling speed in Graph A in FIG. 8 is of such an extent that is just enough to supply hydraulic fluid to the actuator 11 of the power steering system. In this state, the displacement of the gear pump 30 is about 50% or a half of the total displacement of the main gear pump portion P1 and the sub gear pump portion P2. This 50% displacement operation is the small displacement operation of the gear pump 30.

The following will describe the operation of the gear pump 30 when the operation of the gear pump 30 changes from small displacement operation to large displacement operation. When the loading system of a forklift truck is activated, for example, to lift its forks, the forklift truck operator turns a lift lever (not shown) to its ON position. Accordingly, the return conduit 19 for returning hydraulic fluid to the oil reservoir 15 is closed, and hydraulic fluid is supplied to the lift cylinder 12 through the discharge conduit 18 while hydraulic fluid is kept supplied to the actuator 11 of the power steering system from the control valve 13 as shown in FIG. 6.

When hydraulic fluid is supplied to the lift cylinder 12 from the discharge conduit 18, the loading system is activated. The weights of a load and the forks or any other attachment acts on the lift cylinder 12, thereby increasing the pressures in the lift cylinder 12 and the discharge conduit 18. This causes the pressure in the cylinder 72 to increase through the communication conduit 20. Due to the increased pressure in the cylinder 72, the load acting on the second pressure receiving surface 73B of the piston 73 becomes greater than the load acting on the first pressure receiving surface 73A, so that the bypass passage 70 is closed by the piston 73.

When the piston 73 closes the bypass passage 70, the pressure in the discharge-side space 54 is increased by hydraulic fluid flowing from the sub gear pump portion P2. When the pressure in the discharge-side space 54 is increased beyond a predetermined pressure, the valve body 66 of the check valve 65 is moved to open the rear-side discharge passage 63. Thus, hydraulic fluid discharged from the sub gear pump portion P2 is merged with hydraulic fluid discharged from the main gear pump portion P1, and discharged out of the gear pump 30 together. At this time, the displacement of the gear pump 30 is 100% when all hydraulic fluid from the main gear pump portion P1 and the sub gear pump portion P2 is discharged to the control valve 13.

This 100% displacement operation is the large displacement operation of the gear pump 30. The displacement of the gear pump 30 when the gear pump 30 changed from the small displacement operation to the large displacement operation corresponds to the Graph B shown in FIG. 8.

The amount of hydraulic fluid supplied to the lift cylinder 12 is increased with the increase of discharge of hydraulic fluid from the gear pump 30 to the control valve 13, so that the operation speed of the loading system is increased. If the pressure in the upstream passage 70A becomes substantially the same as the pressure in the cylinder 72 while the bypass passage 70 is closed by the piston 73, the bypass passage 70 is kept closed by the piston 73. This is because the area of the second pressure receiving surface 73B is greater than the pressure receiving area of the first pressure receiving surface 73A receiving the pressure in the upstream passage 70A, and the load acting on the second pressure receiving surface 73B is greater than the load acting on the first pressure receiving surface 73A.

The following will describe the operation of the gear pump 30 when the operation of the gear pump 30 changes from large displacement operation to small displacement operation. The forklift truck operator turns the lift lever to its OFF position to lower the forks. Then, no hydraulic fluid is supplied from the supply conduit 16 to the discharge conduit 18, as shown in FIG. 7. The discharge conduit 18 is in communication only with the return conduit 19, and hydraulic fluid in the lift cylinder 12 is flowed to the oil reservoir 15 through the return conduit 19. This causes the forks to be lowered. When the forks are moved to their lowermost position, the load from the lift cylinder 12 acts no more, and therefore, the pressure in the communication conduit 20 is decreased. Thus, while the load acting on the second pressure receiving surface 73B is reduced, the load generated by the pressure in the upstream passage 70A is applied to the first pressure receiving surface 73A, with the result that the piston 73 slides in the direction which opens the bypass passage 70. When the piston 73 opens the bypass passage 70, the pressure in the discharge-side space 54 on the upstream side of the bypass passage 70 is reduced. The urging force of the coil spring 67 and the pressure from the main gear pump portion P1 cause the valve body 66 to close the rear-side discharge passage 63. Thus, the gear pump 30 changes its operation to the small displacement operation. Referring to FIG. 7, hydraulic fluid in the lift cylinder 12 is flowed into the oil reservoir 15 through the return conduit 19, and the pressure in the communication conduit 20 is decreased, so that the gear pump 30 is changed to its small displacement operation.

According to the variable displacement gear pump 30 of the preferred embodiment, the following advantageous effects are obtained.

(1) The piston 73 serving as an opening valve is operated by the pressure differential between the pressures in the upstream passage 70A of the bypass passage 70 and in the discharge conduit 18. The bypass passage 70 is opened and closed by the piston 73, and the rear-side discharge passage 63 is opened and closed by the check valve 65, accordingly. Therefore, the gear pump 30 can change its displacement. Thus, the movement of the piston 73 in the bypass passage 70 is controlled by the pressures in the discharge conduit 18 and the bypass passage 70. Therefore, the gear pump 30 of the preferred embodiment of the present invention can dispense with an electromagnetic valve in the bypass passage 70 as an opening valve as used in the conventional gear pump.

(2) The cross-sectional area of the cylinder 72 is larger than that of the upstream passage 70A of the bypass passage 70. If the pressure in the upstream passage 70A becomes substantially the same as the pressure in the discharge conduit 18 while the bypass passage 70 is closed by the piston 73, the bypass passage 70 is kept closed by the piston 73, reliably. This is because the load acting on the second pressure receiving surface 73B is greater than the load acting on the pressure receiving area of the first pressure receiving surface 73A. Therefore, the gear pump 30 of the present embodiment can dispense with an urging member for applying an urging force to the piston 73 so as to close the bypass passage 70.

(3) The bypass passage 70 is formed in the body 31 and the rear housing 36 of the gear pump 30. There is no need to form a bypass passage out of the gear pump 30. Thus, there is no need to provide an additional arrangement necessary for any external bypass passage provided outside the gear pump. Additionally, the opening valve for opening and closing the bypass passage 70 may be provided in the gear pump 30.

The present invention is not limited to the above-described embodiments, but may be modified variously within the scope of the invention, as exemplified below.

According to the above-described embodiment, the displacement of each of the main and sub gear pump portions P1, P2 is 50% of the maximum or 100% displacement of the gear pump 30. The displacement of the main and sub gear pump portions P1, P2 is not limited to the 50%. Alternatively, for example, the displacement of one of the main and sub gear pump portions P1, P2 may be set 70%, and the displacement of the other may be set 30% in accordance with the requirement of the hydraulic system 10.

According to the above-described embodiment, the gear pump 30 has two gear pump portions, namely the main gear pump portion P1 on the front side and the sub gear pump portion P2 on the rear side. Alternatively, the gear pump 30 may have three or more. In this case, hydraulic fluid discharged from at least one gear pump is introduced into the bypass passage 70 when the gear pump 30 is operating at the small displacement.

According to the above-described preferred embodiment, the bypass passage 70 is formed to extend behind the rear ends of the drive shaft 47 and the driven shaft 48. The bypass passage 70 is not limited to the position described and shown in the above-described preferred embodiment. For example, the bypass passage may be formed to extend around at least one of the drive shaft 47 and the driven shaft 48. In this case, for providing a merging point of the bypass passage and the suction passage on the upstream side of the suction passage, it is preferable to form a bypass passage between the rearmost gear chamber of the gear pump 30 and the rear ends of the drive shaft 47 and the driven shaft 48.

Therefore, the present examples and embodiments are to be considered as illustrative and not restrictive, and the invention is not to be limited to the details given herein but may be modified within the scope of the appended claims.

What is claimed is:

1. A variable displacement gear pump used for a loading system in an industrial vehicle, the industrial vehicle having an actuator of the loading system, a control valve for hydraulically controlling the actuator, and a discharge conduit of the loading system connecting the control valve to the actuator and in which a pressure is increased when loading operation is performed and a pressure is decreased when no loading operation is performed, the variable displacement gear pump comprising:

a main gear pump portion having a main drive gear and a main driven gear engaged with each other, the main gear pump portion having a suction-side space and a discharge-side space formed therein;

a sub gear pump portion having a sub drive gear and a sub driven gear engaged with each other, the sub gear pump portion having a suction-side space and a discharge-side space formed therein;

a suction passage communicating with the suction-side spaces of the main and sub gear pump portions;

a discharge passage communicating with the discharge-side spaces of the main and sub gear pump portions, the discharge passage in communication with the control valve;

a bypass passage returning hydraulic fluid in the discharge-side space of the sub gear pump portion to the suction passage;

a check valve preventing hydraulic fluid in the discharge-side space of the main gear pump portion from flowing to the discharge-side space of the sub gear pump portion, and an opening valve disposed in the bypass passage so as to open the bypass passage when a first pressure receiving surface of the opening valve receives a pressure in the bypass passage that is greater than a pressure on a second pressure receiving surface of the opening valve and so as to close the bypass passage when the first pressure receiving surface of the opening valve receives a pressure that is less than a pressure on the second pressure receiving surface of the opening valve, the second pressure receiving surface disposed so as to receive a pressure in the discharge conduit when a loading operation is preformed, thus no control signal is required to open or close the opening valve.

2. The variable displacement gear pump according to claim 1, wherein the opening valve is in communication with the discharge conduit through a communication conduit so that the second pressure receiving surface receives the pressure in the discharge conduit.

3. The variable displacement gear pump according to claim 1, wherein the opening valve opens the bypass passage when no loading operation is performed.

4. The variable displacement gear pump according to claim 1, wherein the check valve closes when the bypass passage is opened, and the check valve opens when the bypass passage is closed.

5. The variable displacement gear pump according to claim 1, wherein the first pressure receiving surface has a pressure receiving area which receives a discharge pressure from the sub gear pump portion when the bypass passage is closed by the opening valve, and the pressure receiving area of the first pressure receiving surface is smaller than the area of the second pressure receiving surface.

6. The variable displacement gear pump according to claim 1, wherein the opening valve has a piston, wherein the first pressure receiving surface and the second pressure receiving surface are respectively formed on opposite surfaces of the piston.

7. The variable displacement gear pump according to claim 6, wherein the piston is received in a cylinder whose cross-sectional area is larger than the cross-sectional area of the bypass passage on the upstream side of the opening valve.

8. The variable displacement gear pump according to claim 1, wherein a front-side discharge passage extending from the discharge-side space of the main gear pump portion and a rear-side discharge passage extending from the discharge-side space of the sub gear pump portion form the discharge passage, wherein the check valve is arranged in the rear-side discharge passage, wherein the check valve has a valve body opening and closing the rear-side discharge passage, a coil spring urging the valve body so as to close the rear-side discharge passage, and a support member supporting the coil spring.

9. The variable displacement gear pump according to claim 8, wherein the valve body is moved in the direction where the rear-side discharge passage is opened against an urging force of the coil spring when a pressure in the rear-side discharge passage becomes greater than a predetermined pressure, and the valve body is moved to close the rear-side discharge passage by an urging force of the coil spring and a pressure differential between the front-side discharge passage and the rear-side discharge passage when the pressure of the rear-side discharge passage becomes smaller than a predetermined pressure.

* * * * *